United States Patent [19]

Skinner et al.

[11] 4,239,156

[45] Dec. 16, 1980

[54] PAD FOR RAILWAY RAIL FASTENINGS

[75] Inventors: David H. Skinner, Donvale; Jeffrey H. Brown, Armadale, both of Australia

[73] Assignee: The Broken Hill Proprietary Company Limited, Victoria, Australia

[21] Appl. No.: 968,813

[22] Filed: Dec. 12, 1978

[30] Foreign Application Priority Data

Dec. 23, 1977 [AU] Australia ..... PD2885

[51] Int. Cl.[3] ..... E01B 9/68

[52] U.S. Cl. ..... 238/277; 16/150; 16/DIG. 13; 238/196; 238/197; 238/283

[58] Field of Search ..... 238/264, 265, 275, 276, 238/277, 283, 287, 310, 382, 154, 187, 195, 196, 197, 205, 349; 16/143, 150, DIG. 13; D8/323, 325

[56] References Cited

U.S. PATENT DOCUMENTS

| | | | |
|---|---|---|---|
| 3,223,328 | 12/1965 | Moses et al. | 238/382 X |
| 3,819,114 | 6/1974 | Bush | 238/310 X |
| 3,945,566 | 3/1976 | Bush | 238/283 X |

FOREIGN PATENT DOCUMENTS

| | | | |
|---|---|---|---|
| 2253360 | 5/1974 | Fed. Rep. of Germany | 16/DIG. 13 |
| 186334 | 11/1963 | Sweden | 238/349 |
| 896471 | 5/1962 | United Kingdom | 238/283 |
| 938736 | 10/1963 | United Kingdom | 238/283 |

*Primary Examiner*—Randolph A. Reese

*Attorney, Agent, or Firm*—Cushman, Darby & Cushman

[57] ABSTRACT

An insulation pad for rails on sleepers, the pad comprising a base section adapted, in use, to be interposed between a rail and an underlying sleeper, and two upper sections adapted, in use, to extend over the respective upper surfaces of the rail foot, the upper sections being formed integrally with the base section, wherein the upper sections are hingedly connected to the respective side edges of the base section, which hinges are formed by sections of pad material of reduced thickness, and wherein the upper sections and the associated side edges of the base section adjacent the respective hinges incorporate interlocking knuckle and groove arrangements for resisting differential movement between the upper sections and the base section longitudinally of the hinges.

9 Claims, 8 Drawing Figures

PAD FOR RAILWAY RAIL FASTENINGS

Figure 1:
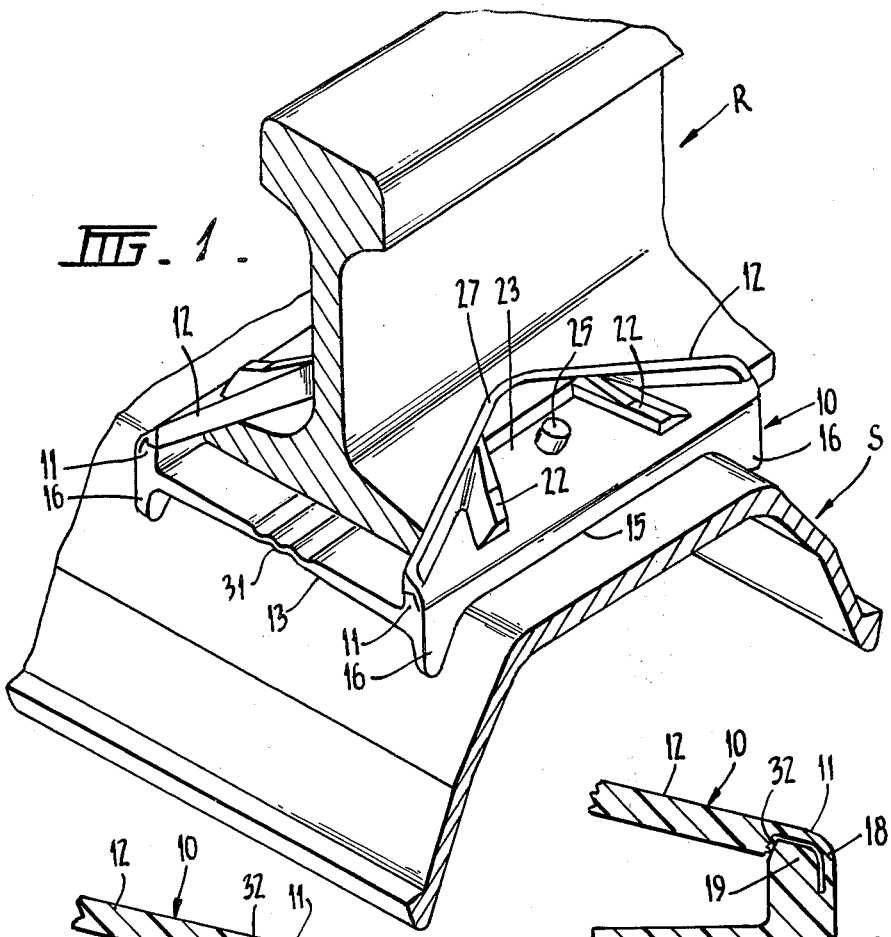

This invention relates to an improved pad to provide insulation of a railway rail from a sleeper.

Insulation of a rail from a sleeper is necessary when railway signalling is performed by passing electric current along the two rails comprising a track and when there is likelihood of electrical short-circuiting between the rails via the sleeper. Under normal circumstances, the presence of a train on such track is signalled by short-circuiting the rails via the wheels and axles of the train. If short-circuiting occurs due to factors other than a train, e.g. electrical leakage across a sleeper, then false and misleading signalling occurs.

Timber sleepers are very poor conductors of electricity and hence, independent insulation of one rail from the other is not necessary. Steel and concrete sleepers are, respectively, good and medium quality conductors of electricity, and for track signalling with these sleepers, insulation of the rails is necessary.

In the past, insulation on steel sleepers has not been widely used. On the other hand, insulation on concrete sleepers has been used widely and successfully in general railway applications, but the existing systems have been shown recently to be not entirely adequate when used for heavy railways. The existing system involves an insulator comprising three components namely, a flat base pad and two identical small shoulders for covering part of the edge and top of the rail foot. The disadvantages of this system are:

(1) more cost is involved in storing, transporting and installing the three components than for a one-piece pad, as is the case of the present invention, (2) there is a possibility that the parts may be installed incorrectly relative to one another, (3) when assembled, the components usually fit together loosely, permitting electrical leakage via several paths, and, (4) due to the poor fit, the components are frequently not aligned properly during assembly and furthermore they may move during the cyclic loading of a passing train.

It is an object of one aspect of the present invention to provide an insulation pad which overcomes some, if not all, of the disadvantages of the known pads.

According to a first aspect of the invention there is envisaged an insulation pad for rails on sleepers, said pad comprising a base section adapted, in use, to be interposed between a rail and an underlying sleeper, and two upper sections adapted, in use, to extend over the respective upper surfaces of the rail foot, said upper sections being formed integrally with said base section and adapted to bend or hinge relative to said base section.

Preferably said upper sections normally overly said base section and are folded back during fitting to the rail foot.

Alternatively the upper sections normally extend upwardly away from the respective side edges of the base section and during fitting are folded over the respective flanges of the rail foot and held in such position by locking means within the pad in the area of bending or hinging, or by associated rail fastening means.

Preferably the upper sections are hingedly connected to the respective side edges of the base section, said hinges being formed by sections of pad material of reduced thickness.

One further disadvantage associated with known insulating pads arises due to the relatively small shoulders which cover edge and top portions of the flanges of the rail foot the small dimensions of which shoulders increases the chances of current leakage from the rail to the associated fastening means and thus to the sleeper. In order to reduce this effect it is advantageous to increase the size of these shoulders.

Preferably the upper sections are respective upper surfaces of the rail foot a distance sufficient to provide a relatively large insulating path between the rail foot and an associated fastening means and are shaped to allow drainage of water and other contaminants down the upper sections and off the pad.

Figure 5:
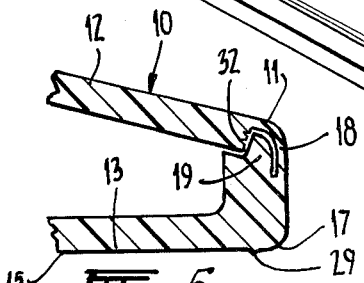
Figure 6:
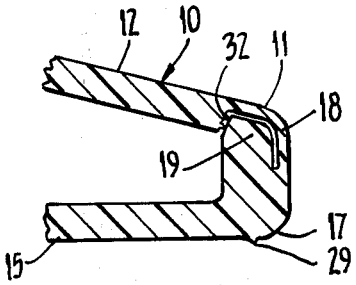
Figure 7:
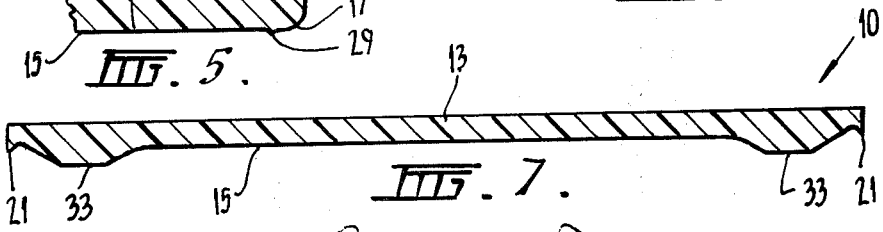
Figure 8:
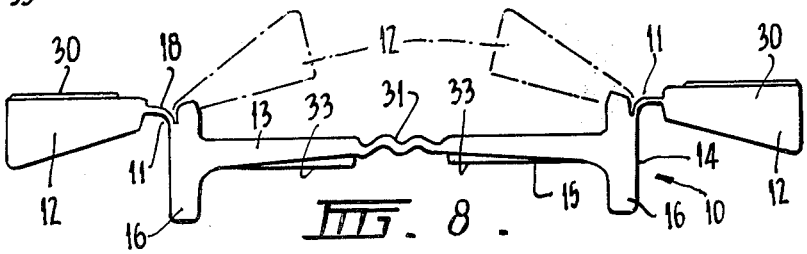
Figure 2:
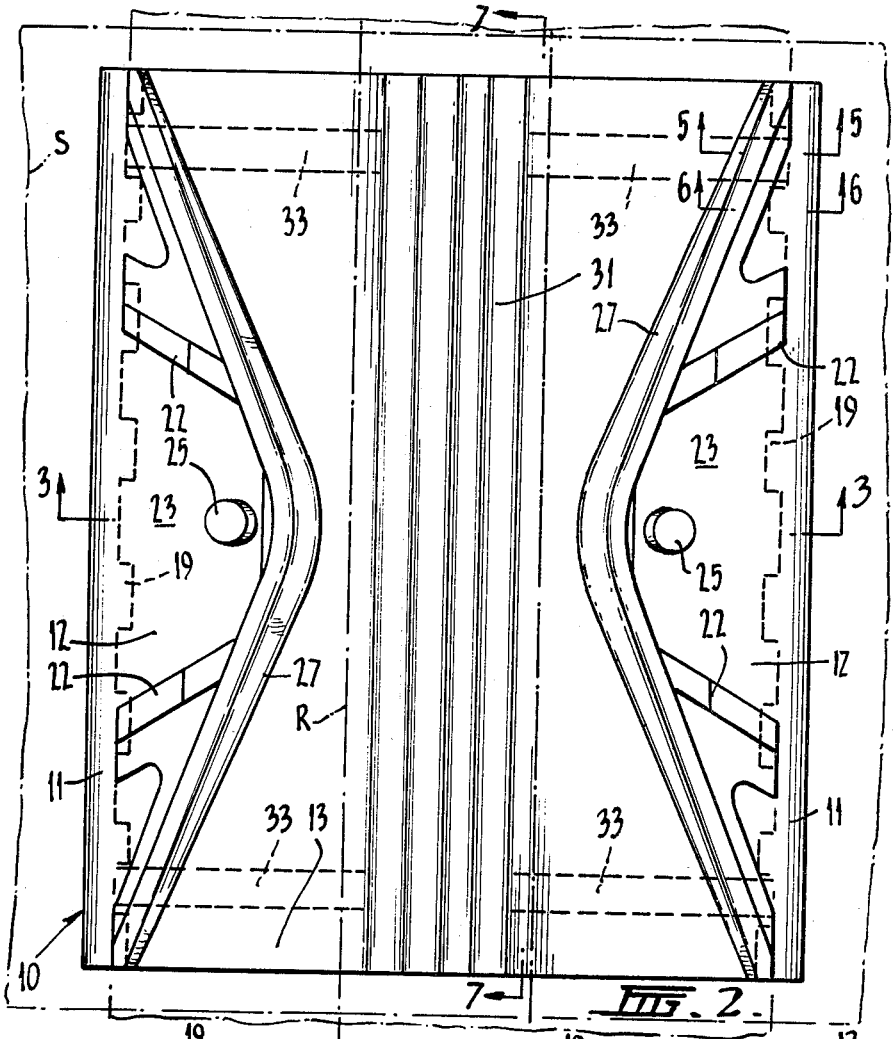
Figure 4:
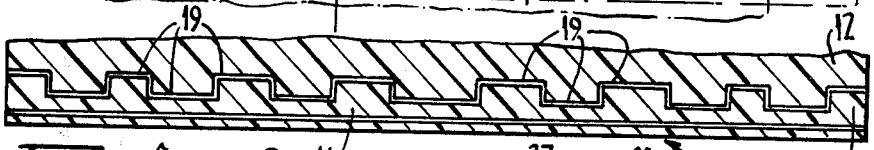
Figure 3:
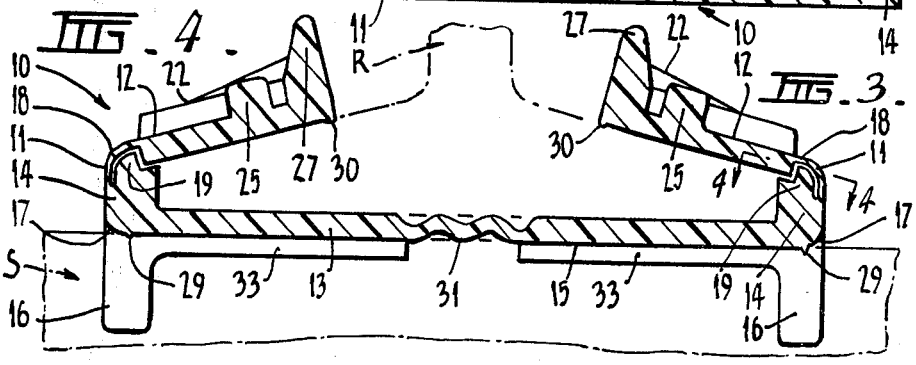

One preferred form of the invention incorporating all aspects of the invention will now be described with reference to the accompanying drawings in which:

FIG. 1 is a perspective view of the pad of this preferred form of the invention incorporated between a rail and a steel sleeper, FIG. 2 is a plan view of the assembly of FIG. 1, FIG. 3 is a cross-sectional view taken along line 3—3 of FIG. 2, FIG. 4 is a cross-sectional view taken along line 4—4 of FIG. 3, FIG. 5 is a cross-sectional view taken along line 5—5 of FIG. 2, FIG. 6 is a cross-sectional view taken along line 6—6 of FIG. 2, FIG. 7 is a cross-sectional view taken along line 7—7 of FIG. 2, and FIG. 8 is an end elevational view of the pad of the assembly of FIG. 1.

The pad of the present invention was developed specifically for steel sleepers, but is applicable to concrete sleepers. The pad encloses the foot of the rail R in the region where it passes over sleepers, and provides sufficiently long electrical leakage paths to prevent short-circuiting between the rail and sleeper under adverse conditions and comprises means of restraining movement of the pad parallel to the rail. The pad 10 is manufactured in one piece and comprises, two hinge mechanisms 11 which permit the upper sections 12 of the pad to fold back, relative to the base section 13, during fitting of it to the rail foot. The hinge mechanisms 11 are manufactured so that they tend to close the upper sections 12 when released and to maintain them in that position.

Preferably the material from which the pad of the present invention is made, is high density polyethylene or similar materials, such as polyurethane, polypropylene etc., with appropriate additives for stabilizing it against U-V radiation. The pad is preferably manufactured by the injection molding process but could be made by any other suitable technique.

The pad 10 has two preferred forms, one suitable for a fastener of the type supplied by OMARK AUSTRALIA PTY. LTD. and another incorporating an additional steel insert, suitable for a fastener of the type known as a Pandrol fastener. However, both preferred forms can be made using the same set of molding dies. The pad can of course be modified to suit other types of fasteners, although the pad illustrated in the drawings incorporates provision for cooperation with a Pandrol type rail fastening system.

In both preferred forms of the invention the pad 10 comprises the substantially flat rectangular base section 13, two opposite vertical side sections 14 and two triangular shaped upper sections 12. The base is about 6 mm thick but may be between 2 mm and 20 mm thick, and its bottom surface 15 is contoured to match the shape of the top of a sleeper S. The base section 13 incorporates four protrusions 16 at the corners thereof which, when the pad is installed, extend part-way down the sides of the sleeper. The purpose of these protrusions 16 is to provide restraint to movement of the pad across the sleeper and to facilitate location of the pad on the sleeper. The protrusions 16 also act to carry water and contaminants away from the pad. Along the edges of the pad extending transversely of the rail there is a narrow ridge 21 (see FIG. 7) for shedding water or other contaminants in such a manner that they do not form a short-circuit between the rail and sleeper across the surface of the pad.

Along the opposite edges of the bottom surface of the base section 13, which are parallel to the direction of the rail, there are small radii 17 to assist in fitting the pad on the sleeper by cooperation with mating radii on the fastening assemblies (not shown) which are supported on the sleeper. Along these edges but on the top surface of the base, are the side sections 14 which are substantially vertical and approximately perpendicular to the base section 13. The thickness of the sides is preferably about 11 mm, but may be between 6 mm and 25 mm.

Between the upper edge of each side section 14 and the associated upper section 12 of the pad, the hinge mechanism 11 is provided which permits the upper section 12 to rotate through an arc of about 90° to facilitate installation of the pad on the rail. The hinge mechanisms 11 are integral parts of the pad and their thickness should preferably be as large as possible in order to withstand damage due to mishandling and/or ultra violet radiation, however it should be thin enough to permit efficient operation of the mechanism. Accordingly the hinge should be about 1–2 mm thick and 5–20 mm high.

With reference to FIGS. 5 and 6, the hinge mechanisms 11 comprise hinge sections 18 of reduced thickness, and further include, on the upper edge of each side section 14 and adjacent to the hinge sections 18, an arrangement of interlocking knuckles and grooves 19. When the pad is in use the interlocking knuckles and grooves 19 interlock with each other to provide restraint to relative (transverse, longitudinal and/or rotational) displacement between the portions of the pad on either side of the hinge sections 18.

In order to hold the upper sections 12 in overlying positions relative to the rail foot and base section 13, to maintain them in position during subsequent fitting of the rail fastening means, locking means 32 (see FIGS. 5 and 6) in the form of radiussed undercuts and feathers are provided at portions of the interface between each side section 12 and the upper top edge of the adjacent side section 14.

The two identical upper sections 12 of the pad 10 are substantially symmetrical and triangular in shape. The thickness of the upper section 12 varies in a complex fashion so that:

(a) There is a pair of sloping ridges 22, between which a depression 23 exists of trapezoidal shape which is symmetrically located and about 10 mm and 15 mm deep, at the narrowest and widest part, respectively. In one preferred form of the invention, when the pad is assembled, the toe of a spring clip (not shown) of a rail fastening system of the type supplied by OMARK AUSTRALIA PTY. LTD. is accommodated in the depression 23. The spring clip is made of steel about 5 mm thick and may be in (electrical) contact with the sleeper. In the pad of the present preferred type a steel insert (not shown) of similar shape to the depression 23 is molded or fitted into the pad 10 in the place where the depression would otherwise be. The insert is substantially flat and preferably about 5 mm, but may be between 3 mm and 8 mm, thick. The purpose of the insert is to distribute the load applied by the toe of a clip, of a Pandrol type rail fastening system, into the pad 10 without damage to the pad. The insert is held in place by virtue of appropriate lug 25 on the pad which engages within a hole in the insert. It will be apparent that all of the upwardly facing surfaces of the upper sections 12 slope downwardly to ensure that water and other contaminants drain off the pad.

(b) A continuous thin upstanding ridge 27 exists along the periphery of the free edge of each upper section 12, to provide a barrier to rain water or other contaminants (e.g. material worn from the rail) which otherwise could form a short-circuit between the rail and spring clip or sleeper, and also act to drain such water and contaminants down the edge of the respective upper section 12 to the corners of the pad, down the protrusion 16 and then away from the pad. The height of the ridge 27 about the rail surface is about 25 mm at the apex of the upper section 12, and about 15 mm near the hinge section 18, to provide a path which is sufficiently long to inhibit electrical leakage under adverse conditions.

The size of the upper sections 12 is such as to provide relatively long electrical leakage paths.

In addition to the four corner protrusions 16, restraint to movement of the pad parallel to the rail is provided by the sloping ridges 22 which act against the edges of the flat spring clip of the fastener, which in turn is locked relative to the sleeper. Also in this preferred form of the invention where a Pandrol type fastening system is used additional restraint is also provided by a pair of lugs on the steel insert which lock onto the housing of the Pandrol type fastening system which in turn is attached to the sleeper.

Small sealing ridges 29 (see FIGS. 3, 5 and 6) run the full length of the undersurface of the base section 13, and small sealing ridges 30 run the full length of the underside of the outer edge of the upper sections 12, as shown, to provide water seals at those points.

A group of corrugations 31 are also formed in the mid section of the base section 13 and extending lengthwise of the rail to allow for expansion of the pad 10 transversely of the rail to allow for small variations in rail foot width, and such as to exert a rail foot engaging force against the edges of the rail foot.

Ridges 33 are also provided extending lengthwise of the sleeper and positioned adjacent each of the four protrusions 16 at the lower corners of the pad, and each ridge 33 extends from its respective protrusion to the corrugated mid-section 31 of the base. The ridges 33 assist in locking the pad against creep movement over the sleeper S insofar as under the clamping force applied by the rail fastening means, or under the weight of rolling stock on the rails, the ridges 33 exert a wedging action between the rail and the sleeper which provides a positive locking action between the pad and the sleeper.

To improve restraint to movement of the rail through the pad, the surfaces of the pad which contact the rail may be roughened. Suitable roughening may be achieved with shot blasting or machining appropriate surfaces of the die.

The pad may be molded in one piece it may be manufactured with the upper sections 12 in the fully opened position, as shown in full lines in FIG. 8, so that no re-entrant molding angles occur and consequently conventional and relatively inexpensive dies may be used. Immediately after molding and before the pad material cools and sets the shape of the pad, the upper section could be moved to the position shown in phantom lines in FIG. 8 so that, in use, they will need to be opened to facilitate attachment to a rail foot and thus will tend to close and engage the rail foot after being released. Such a configuration of the pad is particularly suitable for situations where maintenance work is being done on an existing railway track where old sleepers are being removed and replaced with new sleepers, and the insulating pads are preferably in engagement with the rail while the replacement of sleepers is being carried out.

Alternatively the upper sections 12 could be set perpendicular to, or at an angle slightly in excess of 90° relative to, the base section 13. Such an alternative configuration is particularly suitable when laying a new railway track, where the pads would be firstly positioned on the laid sleepers, the rails then positioned on the pads and the upper sections folded down or closed and held in that position by the fasteners.

We claim:

1. An insulation pad for rails on sleepers, said pad comprising a base section adapted, in use, to be interposed between a rail and an underlying sleeper, and two upper sections adapted, in use, to extend over the respective upper surfaces of the rail foot, said upper sections being formed integrally with said base section and adapted to bend or hinge relative to said base section, said base section being provided with a corrugated section to provide some degree of flexibility of the dimension of the pad transversely of the rail to allow for variation in rail foot widths.

2. An insulation pad for rails on sleepers, said pad comprising a base section adapted, in use, to be interposed between a rail and an underlying sleeper, and two upper sections adapted, in use, to extend over the respective upper surfaces of the rail foot, said upper sections being formed integrally with said base section, wherein the upper sections are hingedly connected to the respective side edges of the base section, which hinges are formed by sections of pad material of reduced thickness, and wherein the upper sections and the associated side edges of the base section adjacent the respective hinges incorporate alternating interlocking knuckle and groove arrangements for resisting differential movement between the upper sections and the base section longitudinally of said hinges.

3. An insulation pad as claimed in claim 2, wherein at least one ridge is provided on the undersurface of the base section such as to, in use, provide a wedging action between the rail and the sleeper to substantially lock the pad against movement relative to the sleeper.

4. An insulation pad, as claimed in claim 2, wherein said two upper sections are adapted, in use, to extend up the respective upper surfaces of the rail foot a distance sufficient to provide a relatively large insulating path between the rail foot and an associated fastening means, while being shaped to allow drainage of water and other contaminants down the upper sections and off the pad.

5. An insulation pad as claimed in claim 4, wherein said upper sections of the pad are substantially triangular in shape and the free edge of each said upper section is provided with an upstanding ridge to assist in draining water and other contaminants down the respective upper section to the lower corners of the pad and off the pad.

6. An insulation pad as claimed in claim 2, wherein the base section is provided with a corrugated section to provide some degree of flexibility of the dimension of the pad transversely of the rail to allow for variation in rail foot widths.

7. An insulation pad as claimed in claim 2, wherein protrusions are provided at each of the lower corners of the pad to, in use, locate and lock the pad in position relative to the sleeper.

8. An assembly of a rail and a sleeper, incorporating an insulation pad as claimed in claim 2.

9. An insulation pad as in claim 2 wherein each of said alternating interlocking knuckle and groove arrangements is provided by a plurality of knuckles and grooves on the respective upper section and on the base section, said knuckles and grooves being arranged along the longitudinal dimension of the hinge and extending transverse to the hinge.

* * * * *

UNITED STATES PATENT AND TRADEMARK OFFICE

CERTIFICATE OF CORRECTION

PATENT NO. : 4,239,156

DATED : December 16, 1980

INVENTOR(S) : David Henry Skinner and Jeffrey Howard Brown

It is certified that error appears in the above—identified patent and that said Letters Patent is hereby corrected as shown below:

Column 2, line 9 should read

--Preferably the upper sections are adapted, in use, to extend up the respective upper--.

Signed and Sealed this

*Fourteenth* Day of *July 1981*

[SEAL]

*Attest:*

GERALD J. MOSSINGHOFF

*Attesting Officer*

*Commissioner of Patents and Trademarks*